US007316641B2

(12) United States Patent
Rehwinkel et al.

(10) Patent No.: US 7,316,641 B2
(45) Date of Patent: Jan. 8, 2008

(54) RECLOSABLE BAGS WITH TAMPER EVIDENT FEATURES AND METHODS OF MAKING THE SAME

(75) Inventors: Gary E. Rehwinkel, Fairport, NY (US); David P. Cameron, Canandaigua, NY (US)

(73) Assignee: Pactiv Corporation, Lake Forest, IL (US)

( * ) Notice: Subject to any disclaimer, the term of this patent is extended or adjusted under 35 U.S.C. 154(b) by 104 days.

(21) Appl. No.: 11/376,827

(22) Filed: Mar. 15, 2006

(65) Prior Publication Data

US 2006/0189467 A1 Aug. 24, 2006

Related U.S. Application Data

(60) Division of application No. 10/457,770, filed on Jun. 9, 2003, now Pat. No. 7,040,808, which is a continuation-in-part of application No. 10/102,003, filed on Mar. 20, 2002, now abandoned.

(51) Int. Cl.
*B31B 1/84* (2006.01)

(52) U.S. Cl. ..... 493/213; 493/212; 493/214; 493/927; 53/412; 53/133.4; 53/139.2

(58) Field of Classification Search ..... 493/212–215, 493/927; 53/412, 133.4, 139.2; 383/5, 63, 383/203, 61.3, 61.2, 207, 204; 156/66; 24/64
See application file for complete search history.

(56) References Cited

U.S. PATENT DOCUMENTS 1,785,234 A 12/1930 Sundback
1,898,216 A 2/1933 Schade et al.
1,923,262 A 8/1933 Goebel
2,035,674 A 3/1936 Sipe
2,064,432 A 12/1936 Keidel (Continued)

FOREIGN PATENT DOCUMENTS

CA 648191 9/1962

(Continued)

OTHER PUBLICATIONS

PCT International Search Report for International Application No. PCT/US03/06891 dated May 30, 2003 (3 pages).

*Primary Examiner*—Hemant M. Desai
(74) *Attorney, Agent, or Firm*—Baker Botts LLP

(57) ABSTRACT

A reclosable package comprises first and second opposing body panels, a reclosable seal and a one-time breakable element. The reclosable seal extends along one end and includes first track and second tracks. The first track includes a first fin portion and a first reclosable element. The first fin portion has a first end and a second end that is further from the first reclosable element. The one-time breakable element comprises first and second sections and initially extends from the first fin portion to the second fin portion. Each of the first and second sections extends upwardly and inwardly from near the respective second ends of the first and second fin portions so as to form a generally inverted U-shaped or V-shaped cross-sectional configuration. The first and second opposing body panels are attached to respective first and second sections of the one-time breakable element.

12 Claims, 6 Drawing Sheets

U.S. PATENT DOCUMENTS

| | | | |
|---|---|---|---|
| 2,070,753 | A | 2/1937 | Schatzky |
| 2,091,617 | A | 8/1937 | Sundback |
| 2,107,216 | A | 2/1938 | Rogers |
| 2,111,079 | A | 3/1938 | Spear et al. |
| 2,161,561 | A | 6/1939 | Dalton |
| 2,193,757 | A | 3/1940 | Beckwith |
| 2,287,349 | A | 7/1942 | Hirsch |
| 2,514,750 | A | 7/1950 | Dobbs et al. |
| 2,560,535 | A | 7/1951 | Allen |
| 2,715,759 | A | 8/1955 | Poux |
| 2,807,265 | A | 9/1957 | Oliva et al. |
| 2,848,031 | A | 8/1958 | Svec et al. |
| 2,869,207 | A | 1/1959 | Bernstein |
| 2,978,769 | A | 4/1961 | Harrah |
| 2,994,469 | A | 8/1961 | Troup et al. |
| 2,997,765 | A | 8/1961 | Markoff-Moghadam |
| 3,054,434 | A | 9/1962 | Ausnit et al. |
| 3,060,985 | A | 10/1962 | Vance et al. |
| 3,103,049 | A | 9/1963 | Hawley |
| 3,115,689 | A | 12/1963 | Jacobs |
| 3,122,807 | A | 3/1964 | Ausnit |
| 3,149,927 | A | 9/1964 | Fady |
| 3,172,443 | A | 3/1965 | Ausnit |
| 3,181,583 | A | 5/1965 | Lingenfelter |
| 3,198,228 | A | 8/1965 | Naito |
| 3,220,076 | A | 11/1965 | Ausnit et al. |
| 3,225,429 | A | 12/1965 | Fady |
| 3,226,787 | A | 1/1966 | Ausnit |
| 3,234,614 | A | 2/1966 | Plummer |
| 3,259,951 | A | 7/1966 | Zimmerman |
| 3,262,634 | A | 7/1966 | Goodwin |
| 3,325,084 | A | 6/1967 | Ausnit |
| 3,338,285 | A | 8/1967 | Jaster |
| 3,339,606 | A | 9/1967 | Kugler |
| 3,371,696 | A | 3/1968 | Ausnit |
| 3,389,441 | A | 6/1968 | Heimberger |
| 3,425,469 | A | 2/1969 | Ausnit |
| 3,426,396 | A | 2/1969 | Laguerre |
| 3,462,068 | A | 8/1969 | Suominen |
| 3,473,589 | A | 10/1969 | Gotz |
| 3,532,571 | A | 10/1970 | Ausnit |
| 3,543,343 | A | 12/1970 | Staller et al. |
| 3,565,147 | A | 2/1971 | Ausnit |
| 3,579,747 | A | 5/1971 | Hawley |
| 3,608,439 | A | 9/1971 | Ausnit |
| 3,633,642 | A | 1/1972 | Slegel |
| 3,634,913 | A | 1/1972 | Ausnit |
| 3,660,875 | A | 5/1972 | Gutman |
| 3,686,719 | A | 8/1972 | Johnston et al. |
| 3,780,781 | A | 12/1973 | Uramoto |
| 3,790,992 | A | 2/1974 | Herz |
| 3,818,963 | A | 6/1974 | Whitman |
| 3,827,472 | A | 8/1974 | Uramoto |
| 3,839,128 | A | 10/1974 | Arai |
| 3,849,843 | A | 11/1974 | Alberts |
| 3,903,571 | A | 9/1975 | Howell |
| 3,909,887 | A | 10/1975 | Yoshida |
| 3,948,705 | A | 4/1976 | Ausnit |
| 3,962,007 | A | 6/1976 | Heimberger |
| 3,972,095 | A | 8/1976 | Kandou |
| 3,991,801 | A | 11/1976 | Ausnit |
| 4,112,990 | A | 9/1978 | Anderson |
| 4,189,809 | A | 2/1980 | Sotos |
| 4,191,230 | A | 3/1980 | Ausnit |
| 4,196,030 | A | 4/1980 | Ausnit |
| 4,212,337 | A | 7/1980 | Kamp |
| 4,235,653 | A | 11/1980 | Ausnit |
| 4,241,865 | A | 12/1980 | Ferrell |
| 4,249,982 | A | 2/1981 | Ausnit |
| 4,262,395 | A | 4/1981 | Kosky |
| 4,263,699 | A | 4/1981 | Moertel |
| 4,285,376 | A | 8/1981 | Ausnit |
| 4,295,919 | A | 10/1981 | Sutrina et al. |
| 4,309,233 | A | 1/1982 | Akashi |
| 4,312,102 | A | 1/1982 | Fukuroi |
| 4,337,889 | A | 7/1982 | Moertel |
| 4,341,575 | A | 7/1982 | Herz |
| 4,363,345 | A | 12/1982 | Scheibner |
| 4,419,159 | A | 12/1983 | Herrington |
| 4,430,070 | A | 2/1984 | Ausnit |
| 4,437,293 | A | 3/1984 | Sanborn, Jr. |
| 4,498,939 | A | 2/1985 | Johnson |
| 4,515,647 | A | 5/1985 | Behr |
| 4,520,534 | A | 6/1985 | De Lima Castro Netto |
| 4,528,224 | A | 7/1985 | Ausnit |
| 4,555,282 | A | 11/1985 | Yano |
| 4,561,109 | A | 12/1985 | Herrington |
| 4,562,622 | A | 1/1986 | Takabatake |
| 4,582,549 | A | 4/1986 | Ferrell |
| 4,589,145 | A | 5/1986 | Van Erden et al. |
| 4,601,694 | A | 7/1986 | Ausnit |
| 4,602,405 | A | 7/1986 | Sturman et al. |
| 4,615,083 | A | 10/1986 | Mayerhofer |
| 4,617,683 | A | 10/1986 | Christoff |
| 4,661,990 | A | 4/1987 | Rifkin |
| 4,666,536 | A | 5/1987 | Van Erden et al. |
| 4,673,383 | A | 6/1987 | Bentsen |
| 4,682,366 | A | 7/1987 | Ausnit et al. |
| 4,709,533 | A | 12/1987 | Ausnit |
| 4,736,450 | A | 4/1988 | Van Erden et al. |
| 4,736,451 | A | 4/1988 | Ausnit |
| 4,744,674 | A | 5/1988 | Nocek |
| 4,756,061 | A | 7/1988 | Jones et al. |
| 4,782,951 | A | 11/1988 | Griesbach et al. |
| 4,791,710 | A | 12/1988 | Nocek et al. |
| 4,825,514 | A | 5/1989 | Akeno |
| 4,832,505 | A | 5/1989 | Ausnit et al. |
| 4,846,585 | A | 7/1989 | Boeckmann et al. |
| 4,890,935 | A | 1/1990 | Ausnit et al. |
| 4,891,867 | A | 1/1990 | Takeshima et al. |
| 4,895,198 | A | 1/1990 | Samuelson |
| 4,923,309 | A | 5/1990 | Van Erden |
| 4,925,316 | A | 5/1990 | Van Erden et al. |
| 4,925,318 | A | 5/1990 | Sorensen |
| 4,947,525 | A | 8/1990 | Van Erden |
| 4,949,527 | A * | 8/1990 | Boeckmann et al. ..... 53/412 |
| 4,966,470 | A | 10/1990 | Thompson et al. |
| 4,969,967 | A | 11/1990 | Sorensen et al. |
| 4,971,454 | A | 11/1990 | Branson et al. |
| 4,987,658 | A | 1/1991 | Horita |
| 5,007,142 | A | 4/1991 | Herrington |
| 5,007,143 | A | 4/1991 | Herrington |
| 5,010,627 | A | 4/1991 | Herrington et al. |
| 5,017,021 | A | 5/1991 | Simonsen et al. |
| 5,020,194 | A | 6/1991 | Herrington et al. |
| 5,022,530 | A | 6/1991 | Zieke |
| 5,023,122 | A | 6/1991 | Boeckmann et al. |
| 5,031,944 | A | 7/1991 | Keyaki |
| RE33,674 | E | 8/1991 | Uramoto |
| 5,036,643 | A | 8/1991 | Bodolay |
| 5,063,069 | A | 11/1991 | Van Erden et al. |
| 5,063,644 | A | 11/1991 | Herrington et al. |
| 5,066,444 | A | 11/1991 | Behr |
| 5,067,208 | A | 11/1991 | Herrington et al. |
| 5,067,822 | A | 11/1991 | Wirth et al. |
| 5,070,583 | A | 12/1991 | Herrington |
| 5,088,971 | A | 2/1992 | Herrington |
| 5,092,684 | A | 3/1992 | Weeks |
| 5,100,246 | A | 3/1992 | La Pierre et al. |
| 5,116,301 | A | 5/1992 | Robinson et al. |
| 5,129,734 | A | 7/1992 | Van Erden |
| 5,131,121 | A | 7/1992 | Herrington et al. |
| 5,152,613 | A | 10/1992 | Herrington, Jr. |
| 5,161,286 | A | 11/1992 | Herrington, Jr. et al. |

| | | | | |
|---|---|---|---|---|
| 5,186,543 | A | 2/1993 | Cochran | |
| 5,189,764 | A | 3/1993 | Herrington et al. | |
| 5,198,055 | A | 3/1993 | Wirth et al. | |
| 5,211,482 | A | 5/1993 | Tilman | |
| 5,253,395 | A | 10/1993 | Yano | |
| RE34,554 | E | 3/1994 | Ausnit | |
| 5,442,838 | A | 8/1995 | Richardson et al. | |
| 5,669,715 | A | 9/1997 | Dobreski et al. | |
| 5,713,669 | A | 2/1998 | Thomas et al. | |
| 5,769,772 | A * | 6/1998 | Wiley | 493/189 |
| 5,775,812 | A | 7/1998 | St. Phillips et al. | |
| 5,788,378 | A | 8/1998 | Thomas | |
| 5,836,056 | A | 11/1998 | Porchia et al. | |
| 5,851,070 | A | 12/1998 | Dobreski et al. | |
| 5,867,875 | A | 2/1999 | Beck et al. | |
| 5,911,508 | A * | 6/1999 | Dobreski et al. | 383/5 |
| 5,956,924 | A | 9/1999 | Thieman | |
| 5,964,532 | A | 10/1999 | St. Phillips et al. | |
| 6,138,439 | A * | 10/2000 | McMahon et al. | 53/412 |
| 6,212,857 | B1 | 4/2001 | Van Erdern | |
| 6,216,423 | B1 | 4/2001 | Thieman | |
| 6,247,843 | B1 | 6/2001 | Buchman | |
| 6,257,763 | B1 | 7/2001 | Stolmeier et al. | |
| 6,264,366 | B1 | 7/2001 | Custer | |
| 6,273,607 | B1 | 8/2001 | Buchman | |
| 6,286,189 | B1 | 9/2001 | Provan et al. | |
| 6,287,000 | B1 | 9/2001 | Buchman | |
| 6,287,001 | B1 | 9/2001 | Buchman | |
| 6,289,561 | B1 | 9/2001 | Provan et al. | |
| 6,290,390 | B1 | 9/2001 | Buchman | |
| 6,290,391 | B1 | 9/2001 | Buchman | |
| 6,290,393 | B1 | 9/2001 | Tomic | |
| 6,292,986 | B1 | 9/2001 | Provan et al. | |
| 6,347,437 | B2 | 2/2002 | Provan et al. | |
| 6,347,885 | B1 | 2/2002 | Buchman | |
| 6,376,035 | B1 | 4/2002 | Dobreski et al. | |
| 6,378,177 | B1 | 4/2002 | Athans et al. | |
| 6,386,760 | B1 | 5/2002 | Tomic | |
| 6,409,384 | B1 | 6/2002 | Provan et al. | |
| 6,427,421 | B1 * | 8/2002 | Belmont et al. | 53/412 |
| 6,439,770 | B2 | 8/2002 | Catchman | |
| 6,499,878 | B1 | 12/2002 | Dobreski et al. | |
| 6,505,383 | B2 | 1/2003 | Machacek et al. | |
| 6,527,444 | B1 * | 3/2003 | Buchman | 383/36 |
| 6,575,625 | B2 | 6/2003 | Cappel et al. | |
| 6,611,996 | B2 | 9/2003 | Blythe et al. | |
| 2002/0015537 | A1 | 2/2002 | Strand et al. | |
| 2002/0071617 | A1 | 6/2002 | Bois | |
| 2002/0097923 | A1 * | 7/2002 | Dobreski et al. | 383/5 |
| 2002/0131653 | A1 * | 9/2002 | Dobreski et al. | 383/5 |
| 2003/0179955 | A1 * | 9/2003 | Rehwinkel | 383/5 |
| 2005/0220375 | A1 * | 10/2005 | Thomas et al. | 383/105 |
| 2006/0291756 | A1 * | 12/2006 | Thomas et al. | 383/105 |
| 2007/0065051 | A1 * | 3/2007 | Eads et al. | 383/63 |

FOREIGN PATENT DOCUMENTS

| | | | |
|---|---|---|---|
| CA | 844815 | | 6/1970 |
| CH | 300325 | | 10/1954 |
| DE | 1 435 827 | | 11/1968 |
| DE | 27 52 703 | | 6/1978 |
| EP | 0 109 793 | A2 | 3/1987 |
| EP | 0 374 539 | A1 | 8/1993 |
| FR | 1 109 532 | | 1/1956 |
| FR | 1 144 870 | | 12/1964 |
| FR | 1 350 126 | | 8/1966 |
| GB | 522663 | | 6/1940 |
| GB | 560103 | | 3/1944 |
| GB | 812842 | | 5/1959 |
| GB | 914203 | | 12/1962 |
| GB | 914204 | | 12/1962 |
| GB | 940266 | | 10/1963 |
| GB | 1012988 | | 12/1965 |
| GB | 2085519 | | 4/1982 |
| GB | 2138494 | | 10/1984 |
| GB | 2268731 | | 1/1994 |
| JP | 61-259959 | * | 11/1986 |
| WO | 91/13759 | | 1/1991 |
| WO | 95/29604 | | 11/1995 |
| WO | 95/35046 | | 12/1995 |
| WO | 95/35047 | | 12/1995 |
| WO | 98/45180 | | 10/1998 |
| WO | 01/46028 | | 11/2000 |

* cited by examiner

RECLOSABLE BAGS WITH TAMPER EVIDENT FEATURES AND METHODS OF MAKING THE SAME

RELATED APPLICATION

This application is a divisional application of application Ser. No. 10/457,770, filed Jun. 9, 2003 now U.S. Pat. No. 7,040,808, which is a continuation-in-part of application Ser. No. 10/102,003 filed on Mar. 20, 2002 now abandoned, Each of these applications is hereby incorporated by reference in its entirety.

FIELD OF INVENTION

The present invention relates generally to the packaging industry. More particularly, the present invention relates to reclosable packages having a tamper evident feature.

BACKGROUND OF THE INVENTION

Reclosable packages or bags are very common, especially in the food industry. Reclosable packages are typically formed by using opposing body panels attached along three sides. Such packages are typically made to be reclosable via the use of a reclosable element or fastener such as a resealable adhesive seal or a reclosable zipper. Such zippers may be opened and closed either by pressure or by the use of an auxiliary slider mechanism.

Reclosable packages are a great convenience to consumers, especially for products such as luncheon meats and cheeses where, typically, only a portion of the product is used at any given time. A problem with these reclosable packages, however, is that the reclosable features do not provide a desired leak resistance. Thus, the contents of the package may leak out of the package and the external atmosphere can permeate into the package, promoting food spoilage. Another problem with reclosable packages is that such packages can be tampered with prior to purchase by the customer.

The reclosable packages may be used by the final manufacturer of, for example, the luncheon meats and cheeses in a form, fill and seal process. It would be desirable to have the reclosable packages formed on and integrated with at least some existing form, fill and seal equipment of these manufacturers without substantial retrofitting.

A need therefore exists for packages to be reclosable and have a desired tamper evident seal that may be used in at least some existing form, fill and seal processes.

SUMMARY OF THE INVENTION

According to one embodiment, a reclosable package comprises a first opposing body panel, a second opposing body panel, a reclosable seal, and a one-time breakable element. The second opposing body panel is joined with the first opposing body panel along three sides to create a receptacle space having a mouth at one end. The reclosable seal extends along the one end and includes a first track and a second track. The first track includes a first fin portion and a first reclosable element, while the second track includes a second fin portion and a second reclosable element. The first fin portion extends generally downwardly from the first reclosable element toward the receptacle space. The first fin portion has a first end and a second end that is further from the first reclosable element. The second fin portion extends generally downwardly from the second reclosable element toward the receptacle space. The second fin portion has a first end and a second end that is further from the second reclosable element. The first reclosable element and the second reclosable element are releasably engageable to each other.

The one-time breakable element comprises a first section and a second section. The one-time breakable element initially extends from the first fin portion to the second fin portion so as to prevent or inhibit tampering with the package prior to being opened. The first section of the one-time breakable element is attached near the second end of the first fin portion. The second section of the one-time breakable element is attached near the second end of the second fin portion. Each of the first and second sections extends upwardly and inwardly from near the respective second ends of the first and second fin portions so as to form a generally inverted U-shaped or V-shaped cross-sectional configuration. The first opposing body panel is attached to the first section of the one-time breakable element and the second opposing body panel is attached to the second section of the one-time breakable element.

The first reclosable element may include a first locking profile and the second reclosable element may include a second locking profile. The package may further include a slider mechanism slidably mounted to the first and second locking profiles for movement between an open and a closed position.

According to another embodiment, a reclosable package comprises a first opposing body panel, a second opposing body panel, a reclosable seal, and a one-time breakable element. The second opposing body panel is joined with the first opposing body panel along three sides to create a receptacle space having a mouth at one end. The reclosable seal extends along the one end and includes a first track and a second track. The first track includes a first fin portion and a first reclosable element. The second track includes a second fin portion and a second reclosable element. The first fin portion extends generally downwardly from the first reclosable element toward the receptacle space. The first fin portion has a first end and a second end that is further from the first reclosable element. The second fin portion extends generally downwardly from the second reclosable element toward the receptacle space. The second fin portion has a first end and a second end that is further from the second reclosable element. The first reclosable element and the second reclosable element are releasably engageable to each other.

The one-time breakable element comprises a first section and a second section. The one-time breakable element initially extends from the first fin portion to the second fin portion so as to prevent or inhibit tampering with the package prior to being opened. Each of the first and second sections extends upwardly and inwardly from respective second ends of the first and second fin portions so as to form a generally inverted U-shaped or V-shaped cross-sectional configuration. The first and second sections of the one-time breakable element and the first and second fin portions are integrally connected with each other. The first opposing body panel is attached to the first section of the one-time breakable element and the second opposing body panel is attached to the second section of the one-time breakable element.

According to one process, a reclosable package is formed that comprises providing a first opposing body panel and a second opposing body panel that is joined with the first opposing body panel along three sides to create a receptacle space having a mouth at one end. A reclosable seal is extruded and includes a first track and a second track. The first track includes a first fin portion and a first reclosable element. The second track includes a second fin portion and a second reclosable element. The first fin portion extends generally downwardly from the first reclosable element. The first fin portion has a first end and a second end that is further from the first reclosable element. The second fin portion extends generally downwardly from the second reclosable element. The second fin portion has a first end and a second end that is further from the second reclosable element. The first reclosable element and the second reclosable element are releasably engageable to each other. The one-time breakable element comprises a first section and a second section. The one-time breakable element initially extends from the first fin portion to the second fin portion so as to prevent or inhibit tampering with the package prior to being opened. Each of the first and second sections extends upwardly and inwardly from respective second ends of the first and second fin portions so as to form a generally inverted U-shaped or V-shaped cross-sectional configuration. The first and second sections of the one-time breakable element and the first and second fin portions are integrally connected with each other.

The first opposing body panel is attached to the first section of the one-time breakable element. The second opposing body panel is attached to the second section of the one-time breakable element. The first fin portion extends generally downwardly from the first reclosable element toward the receptacle space. The second fin portion extends generally downwardly from the second reclosable element toward the receptacle space and the reclosable seal extends along the one end of the receptacle space.

BRIEF DESCRIPTION OF THE DRAWINGS

Other advantages of the invention will become apparent upon reading the following detailed description and upon reference to the drawings.

DESCRIPTION OF ILLUSTRATIVE EMBODIMENTS

Figure 1A:
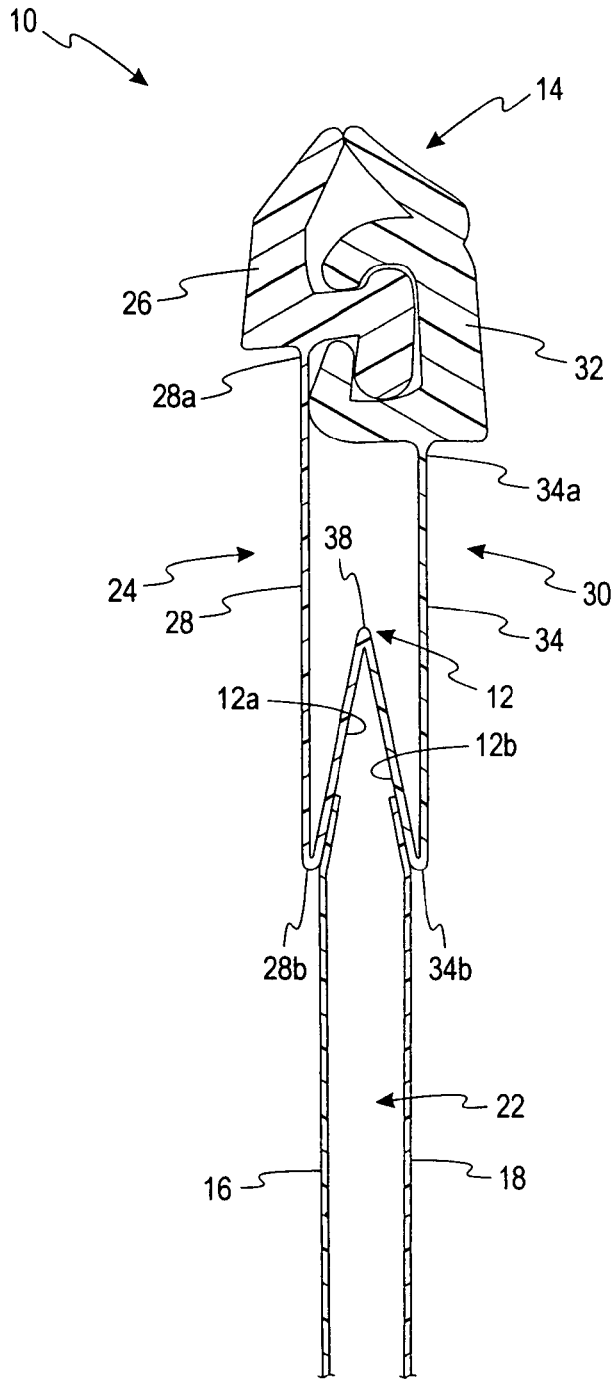
FIG. 1*a* is a sectional view of a mouth portion of a reclosable package or bag according to one embodiment of the present invention.
Figure 2:
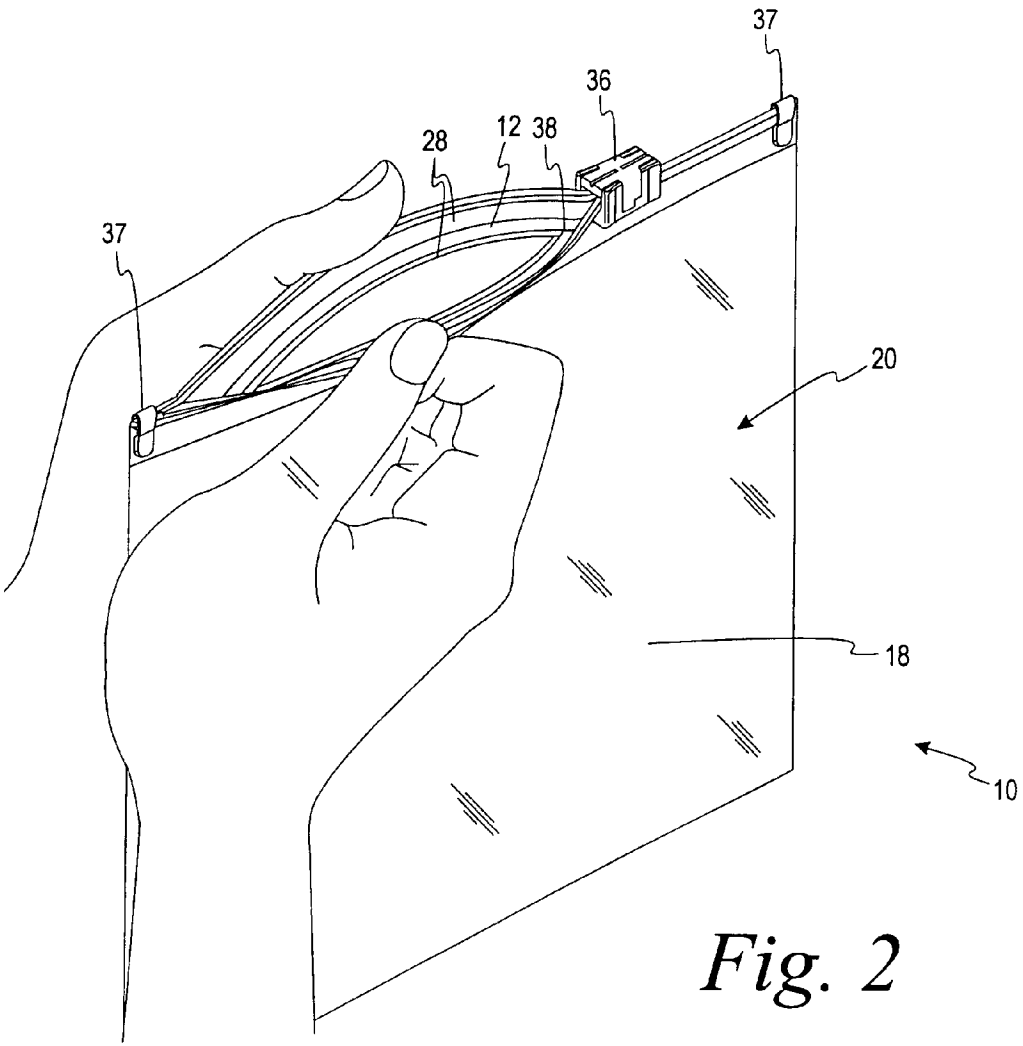
FIG. 2 is a perspective view of the reclosable package incorporating the mouth portion depicted in FIG. 1 in which a reclosable fastener or zipper has a slider mechanism being opened and the one-time breakable element being partially opened.

Turning now to the drawings, FIG. 1*a* depicts a mouth portion of a reclosable package or bag 10 having a one-time breakable element or tamper evident feature 12 located below a reclosable closure arrangement such as fastener or zipper 14. FIG. 2 shows the reclosable package 10 with the mouth portion depicted in FIG. 1*a* in a partial open position.

Referring still to FIGS. 1*a* and 2, the mouth portion of the reclosable package 10 includes a pair of first and second opposing body or wall panels 16, 18 that make up a package body 20 and define a receptacle space 22. Connected to the first body panel 16 is a first track 24 having a first profile 26 and a first fin portion 28 extending generally downward from the first profile 26. Connected to the second body panel 18 is a second track 30 having a second profile 32 and a second fin portion 34 extending generally downward from the second profile 32. The first and second profiles 26, 32 are releasably engageable with each other to provide a reclosable seal to the package 10.

Figure 1B:
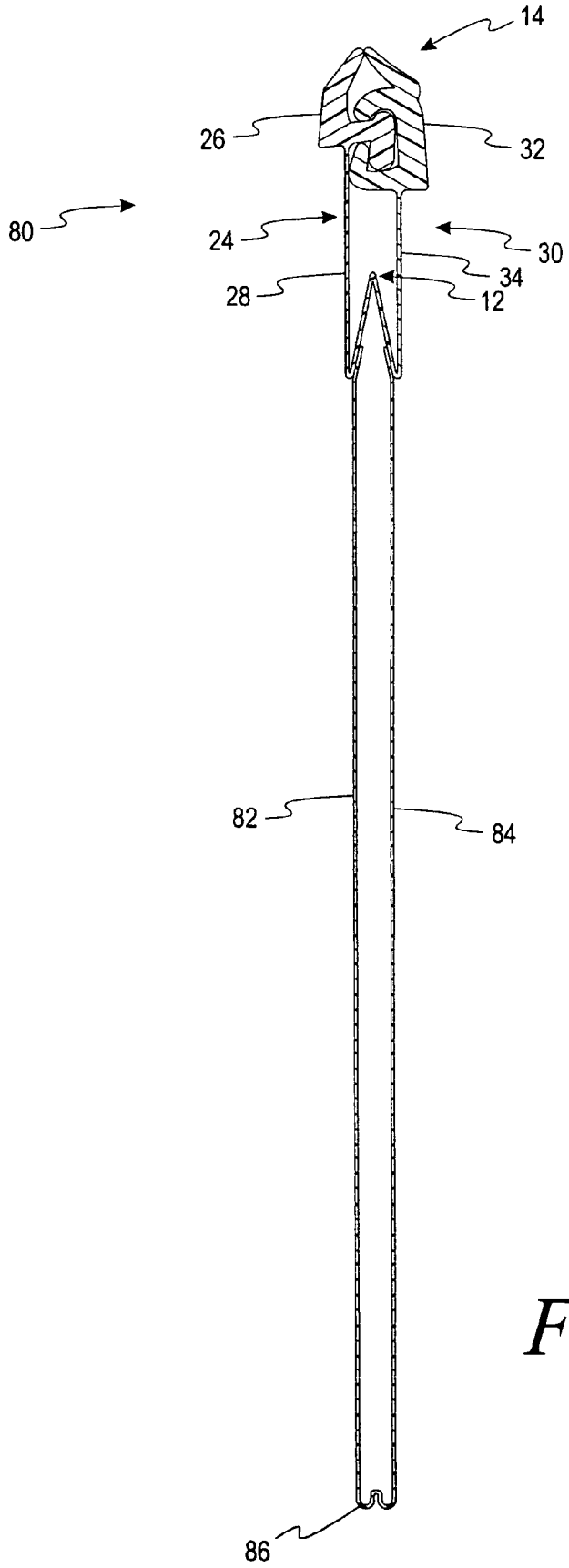
FIG. 1*b* is a sectional view of a reclosable package or bag according to one embodiment of the present invention.

FIG. 1*b* depicts a reclosable package or bag 80 having the one-time breakable element 12 located below the fastener 14. The package or bag 80 of FIG. 1*b* includes first and second opposing body panels 82, 84 that form a bottom gusset 86 at an end opposite of the fastener 14.

Figure 1C:
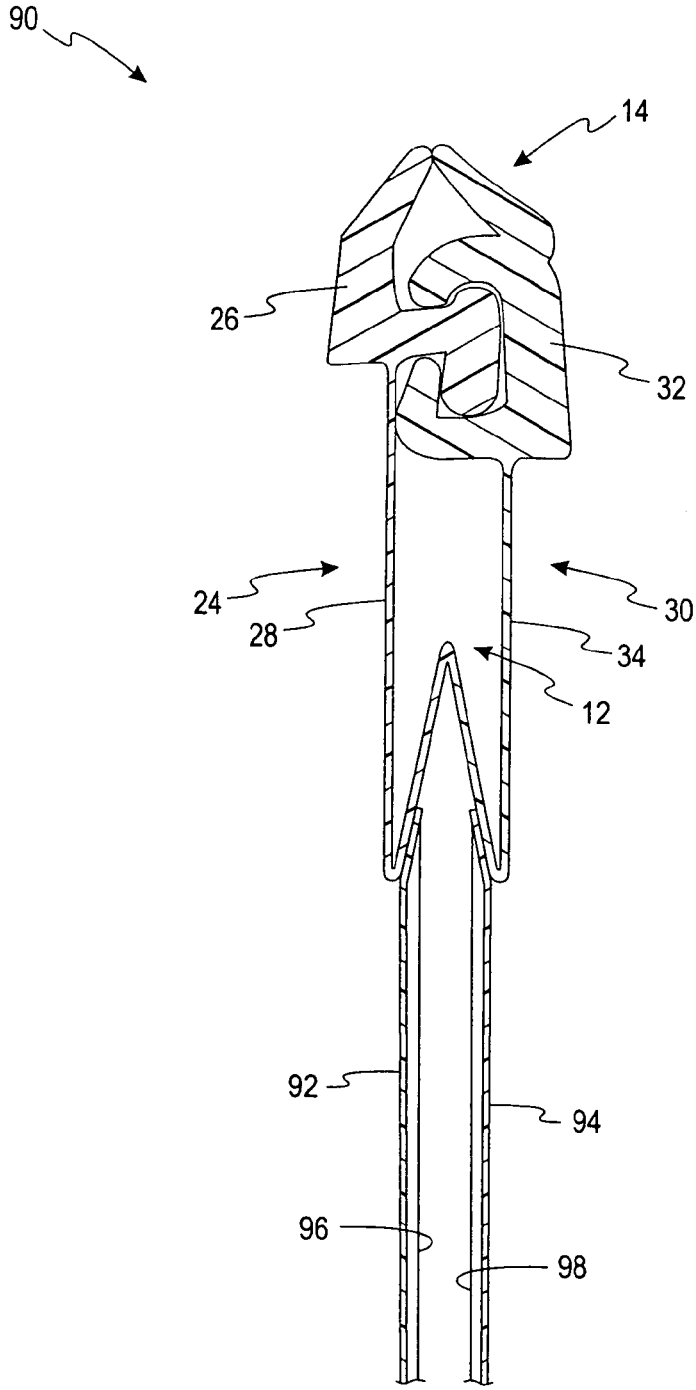
FIG. 1*c* is a sectional view of a mouth portion of a reclosable package or bag according to another embodiment of the present invention.

FIG. 1*c* depicts a mouth portion of a reclosable package or bag 90 having the one-time breakable element 12 located below the fastener or zipper 14. The package or bag 90 includes first and second opposing body panels 92, 94. Each of the opposing body panels 92, 94 forms a respective side gusset 96, 98.

In the embodiment of FIG. 1*a*, the one-time breakable element 12 initially extends from the first fin portion 28 to the second fin portion 34. The first fin portion 28 includes a first end 28*a* and a second end 28*b*, while the second fin portion 34 includes a first end 34*a* and a second end 34*b*. The one-time breakable element 12 includes a first section 12*a* and a second section 12*b*. The first section 12*a* of the one-time breakable element 12 according to one embodiment is attached near or, more specifically, at the second end 28*b* of the first fin portion. Similarly, the second section 12*b* of the one-time breakable element according to one embodiment is attached near or at the second end 34*b* of the second fin portion 34.

The one-time breakable element 12 of FIG. 1*a* is depicted with an optional one-time breakable preferential area of weakness or preferential tear area 38 to form a one-time breakable tamper evident feature. It is not necessary that the one-time breakable element 12 has a one-time breakable preferential area of weakness 38. For example, the one-time breakable element 12 may be made in a manner to separate by cutting therethrough. The preferential area of weakness 38 inhibits tampering with the bag 10 prior to being opened. The one-time breakable element may have a generally inverted U-shape (see, e.g., FIG. 3) or a generally inverted V-shape (see, e.g., FIG. 1*a*-1*c*) cross-sectional configuration.

Referring back to FIGS. 1*a-c*, the first and second fin portions 28 and 34 and the first and second sections 12*a, b* of the one-time breakable element 12 according to another embodiment are integrally formed with each other. For example, the one-time breakable element 12 may be extruded with the fin portions 28, 34 as a single continuous piece having the preferential area of weakness 38. In one embodiment, the preferential area of weakness 38 takes the form of a score line or a series of perforations (also referred to as a perforated line). A score line may be created by making a uniform crease in the general center of the one-time breakable element 12. Alternatively, a score line may be formed on any portion(s) of the one-time breakable element 12. A score line may be created by extruding the one-time breakable element 12 with less polymeric material along a portion thereof. The score line may also be formed by laser techniques. In another embodiment, the preferential area of weakness 38 results from forming the single continuous piece out of a region of highly oriented polymeric material that has a tendency to split along the preferential area of weakness 38.

Instead of extruding the one-time breakable element 12 with the first and second fin portions 28, 34 as a single continuous piece, the one-time breakable element 12 and the fin portions 28, 34 may be separately extruded and then later weakly attached. For example, the one-time breakable element 12 may be attached near or at the second ends 28*b*, 34*b* of the respective fin portions 28, 34 by heat sealing or welding. The one-time breakable element 12 may be attached to the respective fin portions 28, 34 by elastomeric ribs. The weak attachment of the one-time breakable element 12 with the first fin portion 28 and/or the second fin portion 34 may create a preferential area of weakness.

Figure 3:
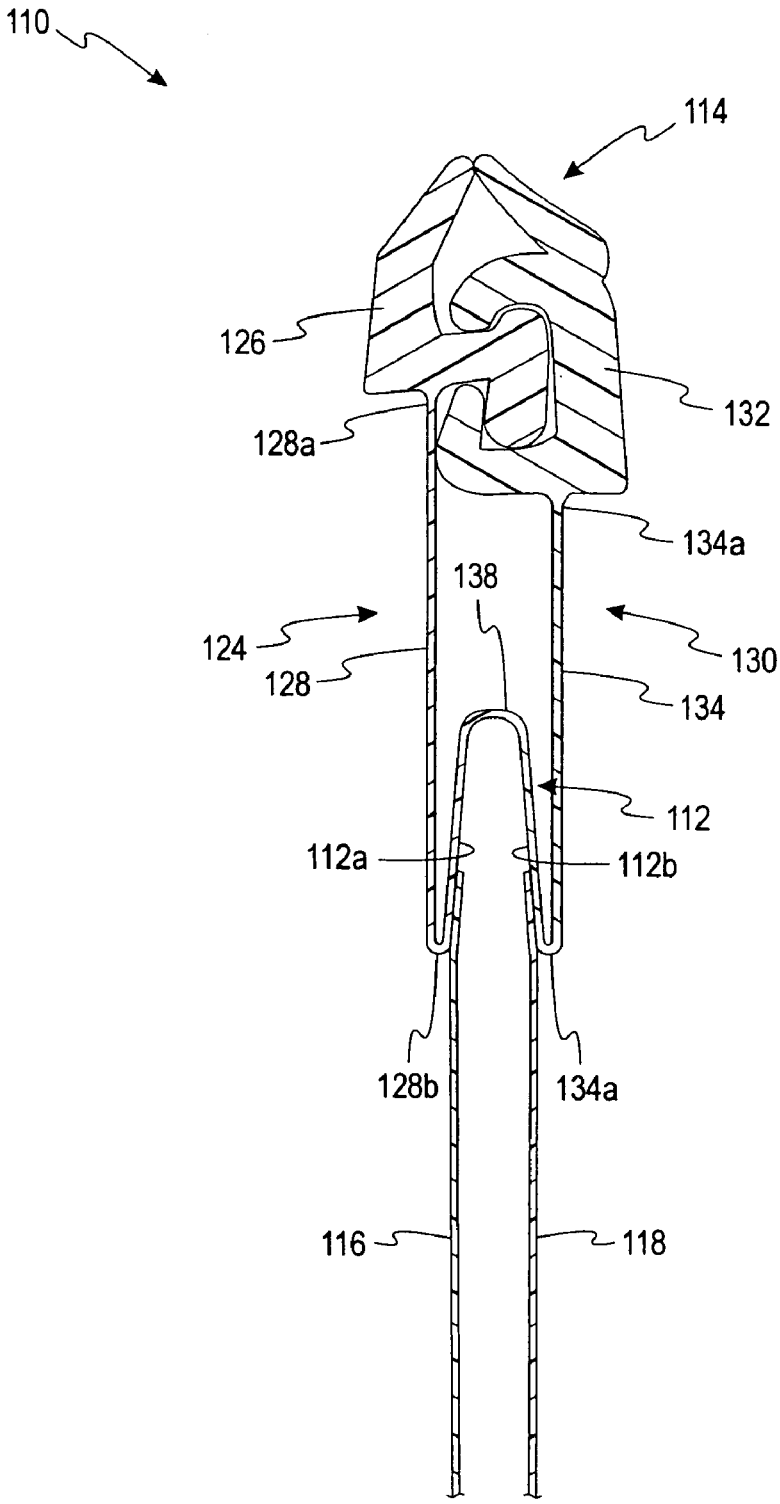
FIG. 3 is a sectional view of a mouth portion of a reclosable package or bag according to a further embodiment of the present invention.

Referring to FIG. 3, the reclosable bag or package 110 includes a one-time breakable element 112 located below a fastener or zipper 114. As described above with respect to FIGS. 1*a* and 2, the reclosable package 110 of FIG. 3 includes opposing body panels 116 and 118 attached to a respective first section 112*a* and second section 112*b* of the one-time breakable element 112. The first track 124 includes a first profile 126 and first fin portion 128 with first and second ends 128*a, b*. The second track 130 includes a second profile 132 and second fin portion 134 with first and second ends 134*a, b*.

Figure 4:
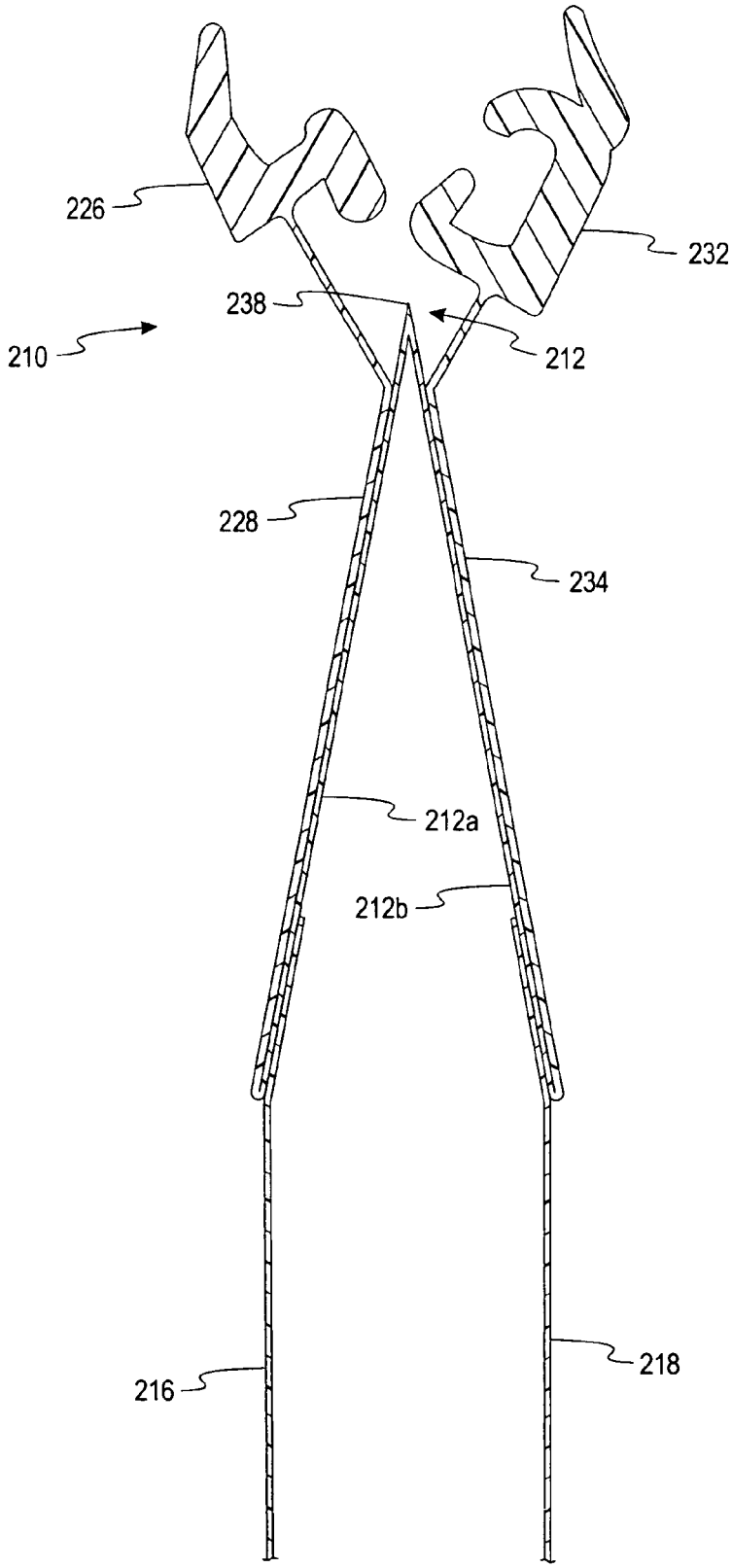
FIG. 4 is a sectional view of a mouth portion of a reclosable package or bag in an open position according to yet another embodiment of the present invention.

As shown in FIG. 4, a reclosable bag or package 210 is shown with profiles 226, 232 and respective first and second fin portions 228, 234 extending therefrom. The reclosable bag 210 includes a one-time breakable element 212 that includes a first section 212*a* and a second section 212*b*. The one-time breakable element 212 includes an optional one-time breakable preferential area of weakness or preferential tear area 238.

A majority of the first section 212*a* of the one-time breakable section 212 may be attached to a first fin portion 228, by, for example, an adhesive or heat sealing. This attachment may occur even if the first fin portion 228 and the first section 212*a* are integrally extruded with each other such as shown in FIG. 4. Thus, the first section 212*a* may integrally formed with the first fin portion 228 then folded thereon and attached. Alternatively, the first section 212*a* and first fin portion 228 may be separately formed and attached. Alternatively, substantially all of the first section 212*a* of the one-time breakable section 212 may be attached to the first fin portion 228. In such an embodiment, the first section 212*a* and first fin portion 228 may be integrally formed or separately formed.

Similarly, a majority of the second section 212*b* of the one-time breakable section 212 may be attached to a second fin portion 234 by, for example, an adhesive or heat sealing. As discussed above, the second section 212*b* and the second fin portion 234 may be integrally formed or separately formed. Alternatively, substantially all of the second section 212*b* of the one-time breakable section 212 may be attached to the second fin portion 234. It is contemplated that the first section 212*a*, the second section 212*b*, the first fin portion 228 and the second fin portion 234 may be integrally formed with each other.

The thicknesses of the one-time breakable element 12 and the first and second fin portions 28, 34 is generally from about 2 to about 10 mils. The thicknesses of one-time breakable element 12 and the first and second fin portions 28, 34 are typically from about 6 to about 8 mils. The thickness of the one-time breakable element may be greater if elastomeric ribs are used (e.g., generally from about 12 to about 14 mils). The area of weakness, such as the preferential area of weakness 38, is generally from about 0.5 mil to about 2 mils.

According to another embodiment, the reclosable package 10 further includes an optional auxiliary slider mechanism 36 (FIG. 2) slidably mounted to the fastener 14 for movement between a closed position and an open position. Referring to FIGS. 1*a*-1*c* and 2, the first and second profiles 26, 32 are engaged to each other while the slider mechanism 36 is in the closed position, and movement of the slider mechanism 36 from the closed position to the open position disengages the profiles 26, 32 from each other.

The package 10 of FIG. 2 also includes end terminations 37. End terminations may have various purposes such as (a) preventing or inhibiting the slider mechanism 36 from going past the ends of the fastener 14, (b) interacting with the slider 36 to give a tactile indication of being closed, (c) assisting in inhibiting or preventing leakage from the package 10 and (d) holding the first and second profiles 26, 32 together and providing additional strength in resisting stresses applied to the profiles 26, 32 during normal use of the package 10. Further details concerning the construction and operation of the slider mechanism 36 and the end terminations 37 may be obtained from U.S. Pat. No. 5,067,208 to Herrington, Jr. et al.

It is contemplated that other end terminations may be used instead of the above-described end terminations 37. For example, an end weld may be formed by heated bars pressed against the end of the fastener, ultrasonic welding or other ways known in the art.

As illustrated in FIGS. 1*a*-1*c* and 2, in order to open the reclosable package 10 of the present invention, a consumer grips the slider mechanism 36 and moves it such that the first and second profiles 26, 32 of the respective first and second tracks 24, 30 are detached from each other. Next, the consumer tears open the one-time breakable element 12 along the preferential area of weakness 38. Alternatively, the consumer may open the one-time breakable element 12 by cutting therethrough. The package can be resealed utilizing the fastener 14 and slider mechanism 36. Specifically, the consumer grips the slider mechanism 36 and moves it from the open position to the closed position so as to engage the complementary first and second profiles 26, 32.

The one-time breakable element 12 not only provides a consumer with the assurance that his or her newly purchased package has never been opened before, but also provides a good initial seal that preserves the freshness of the food contents of the package prior to its initial opening. Since the reclosable closure arrangements of FIGS. 1-4 are located above the one-time breakable element, (i.e., the reclosable closure arrangement is further from the receptacle space), the operation of the reclosable closure arrangement is not hampered by the presence of the one-time breakable element.

For example, it is generally not desirably to have pull flanges that extend upwardly from the reclosable closure arrangement that can be grasped and pulled apart to open the reclosable closure arrangement from a sealed form. Such a reclosable package may interfere with the operation of opening and closing the package, resulting in customer dissatisfaction. Additionally, this type of package also includes another step for the customer of removing a tear strip or manually cutting the wall panels to gain access to the package. This type of package also includes higher product costs involved with using additional resins for extending the body panels.

The tracks, profiles, fin portions and one-time breakable element typically comprise one or more polymeric resins. The tracks, profiles, fin portions and one-time breakable element may be independently comprised of one or more polyolefins including, but not limited to, polyethylenes, polypropylenes or combinations thereof. Some non-limiting types of polyethylenes include low density polyethylenes (LDPE), linear low density polyethylenes (LLDPE), high density polyethylenes (HDPE), medium density polyethylenes (MDPE) and combinations thereof. Other non-limiting examples include plastomers, elastomers, ethylene Vinyl acetates (EVA), ethyl methacrylates, polymethylpentene copolymers, polyisobutylenes, polyolefin ionomers, cyclic olefin copolymers (COCs) or combinations thereof, including with polyethylenes and/or polypropylenes.

One or more of the tracks, profiles, fin portions and/or one-time breakable element may be made from multiple layers. The multiple layers of the tracks, profiles, fin portions and one-time breakable element may be independently formed by coextruding or other processes such as coating or laminating.

According to one embodiment, the opposing films forming the opposing body panels 16, 18 of the package may be made of one or more polymeric resins. Opposing body panels 116, 118 (FIG. 3) and 216, 218 (FIG. 4) may be made of the same materials as the opposing body panels 16, 18. The opposing body panels 16, 18 may be comprised of one or more polyolefins including, but not limited to, polyethylenes, polypropylenes or combinations thereof. Some non-limiting types of polyethylenes include low density polyethylenes (LDPE), linear low density polyethylenes (LLDPE), high density polyethylenes (HDPE), medium density polyethylenes (MDPE) and combinations thereof. Other non-limiting examples include plastomers, elastomers, ethylene vinyl acetates (EVA), ethyl methacrylates, polymethylpentene copolymers, polyisobutylenes, polyolefin ionomers, cyclic olefin copolymers (COCs) or combinations thereof, including with polyethylenes and/or polypropylenes.

Furthermore, the opposing body panels 16, 18 of the present invention may be made of multiple layers including those layers joined by coextrusion or other processes such as coating or laminating. Similarly, the opposing body panels 116, 118 and 216, 218 may be made of such multiple layers. It is further possible to incorporate pigments, metallic components, paper, and/or paper/plastic composites into or on the layer(s) of the opposing body panels.

According to a further embodiment, the opposing body panels may be formed from a multi-wall paper construction. One non-limiting example of such a construction is a pinch bottom open mouth bag that is used in the pet food industry. It is contemplated that other types of multi-wall paper construction may be used in forming the opposing body panels.

The optional slider mechanism 36 may be formed from suitable polymeric materials such as, for example, nylon, polypropylene, polyethylene, polystyrene, copolymers of polyethylene and polypropylene, polycarbonates, polyesters, polyacetals, or acrylic- butadiene-styrene copolymers. Especially preferred components for making the slider mechanism 36 are polypropylenes, polycarbonates or polyesters. The slider mechanism 36 may be formed by injection molding.

As discussed, the one-time breakable element may be formed from one or more layers. According to one embodiment, the one-time breakable element 12 may also be a barrier partition that includes a barrier layer that is substantially impermeable to at least one of oxygen, nitrogen, carbon dioxide and/or water vapor. Similarly, the one-time breakable elements 112 (FIG. 3) and 212 (FIG. 4) may include such layers. The optional preferential area of weaknesses 38, 138, 238 of respective one-time breakable elements 12, 112, 212 may also be substantially impermeable to at least one of oxygen, nitrogen, carbon dioxide and/or water vapor. If substantially impermeable to at least oxygen, nitrogen, carbon dioxide and/or water vapor, the one-time breakable element assists in preserving the freshness of the food contents of the package prior to its initial opening. The freshness of the food is preserved by reducing gases from the external atmosphere causing food spoilage.

The optional barrier layer of the one-time breakable element may comprise ethylene vinyl alcohols (EVOH), polyvinyl alcohols (PVOH), nylons, polyesters, ethylene vinyl dichlorides (EVDC), liquid crystal polymers (LCPs), polyvinyl chloride (PVC), polyvinylidene chloride (PVDC), modified polyolefins with barrier properties, polyacrylonitriles, acrylonitrile copolymers, polyacetals, cellophanes, cyclic olefin copolymers (COCs) or combinations thereof. More specifically, the optional barrier layer of the one-time breakable element is made of an EVOH, PVDC, nylon or polyester. Preferred nylons include nylon-6, nylon-66, nylon-MXD6 and amorphous nylons. Preferred polyesters include polyethylene terephthlate (PET) and polybutylene terephthlate (PBT).

If it is desirable to have an effective water vapor barrier, a cyclic olefin copolymer such as TOPAS® 8007 may be used. TOPAS® 8007 is made by Ticona, a business of Calanese AG, in Summit N.J. This cyclic olefin copolymer is believed to be prepared with feedstocks of norbornene and ethylene and the use of a metallocene catalyst. The TOPAS® 8007 has a glass transition temperature, $T_g$, of about 85° C. with a norbornene level believed to be about 39 mole %.

There are believed to be at least three other grades of TOPAS® resins available (TOPAS® 6013, TOPAS® 6015 and TOPAS® 6017). Other companies that have cyclic olefin copolymers available include Nippon Zeon (Japan), Mitsui Chemical (Japan) and JSR (Japan), formerly know as Japan Synthetic Rubber. These cyclic olefin copolymers are believed to be prepared with feedstocks of norbornene and ethylene and the use of a metallocene catalyst. The three grades of TOPAS® resins available have glass transition temperatures, $T_g$, of 140, 160 and 180° C., respectively. The corresponding norbornene levels of the four grades of TOPAS® resins are believed to be about 48, 55 and 59 mole %.

It is preferred that water soluble materials, such as PVOH, do not comprise the optional barrier layer if the one-time breakable element is made of only the barrier layer because those materials may dissolve in a moisture environment, lose strength and/or barrier characteristics.

According to one embodiment, a five layer barrier layer is contemplated. The five layer barrier layer has polymeric outer layers such as, for example, high density polyethylene (HDPE), ultra low density polyethylene (ULDPE) and low density polyethylene (LDPE). The interior layer is made of ethylene vinyl alcohol (EVOH). The EVOH layer is attached to the outer polymeric layers via adhesive layers such as ethyl vinyl acetate (EVA). Another example of an adhesive is an anhydride modified LDPE that has a melt index (MI) of about 1.8 g/10 min. and a density of about 0.92 g/cm$^3$.

The optional barrier layer generally has an oxygen transmission rate (OTR) less than 10 cm$^3$ (mil)/100 in$^2$-day at 23° C. as measured by ASTM D3985-81. The barrier layer preferably has an oxygen transmission rate less than 2 cm$^3$ (mil)/100 $in^2$-day at 23° C. and, more preferably, less than 0.5 $cm^3$ (mil)/100 $in^2$-day at 23° C. as measured by ASTM D3985-81.

The optional barrier layer may also be substantially impermeable to water vapor and other gases causing dehydration, increased humidification and/or oxidation. The optional barrier layer generally has an water vapor transmission rate (OTR) less than 20 g/100 $in^2$-day at 23° C. as measured by ASTM F1249-90. The ASTM F1249-50 has been slightly modified in Section 11.2 to normalize and account for the small width of the track. The barrier layer preferably has an oxygen transmission rate less than 5 g/100 $in^2$-day at 23° C. and, more preferably, less than 1 g/100 $in^2$-day at 23° C. as measured by ASTM F1249-90.

The optional barrier layer may assist in inhibiting loss of flavor, absorption of external odors and development of microflora (bacteria) in the food products of the package.

It is contemplated that oxygen absorbers/scavengers may be included in forming the optional barrier layer. Oxygen absorbers or scavengers are generally chemical or enzyme based. Chemical oxygen scavengers contemplated in the present invention include metallic reducing agents such as various ferrous compounds, powdered iron oxide and metallic platinum. Other chemical oxygen scavengers include non-metallic formulations such as those employing ascorbic acids (Vitamin C) and their associated salts and organometallic molecules that have a natural affinity for oxygen.

It is contemplated that additional materials may be added in forming the optional barrier layer. These materials include various fillers, such as clay, talc, mica and nanocomposites that may be more cost effective. These fillers may provide a tortuous path for oxygen, nitrogen, carbon dioxide and/or water vapor.

Similarly, the opposing body panels 16, 18 (FIGS. 1*a*-1*c*), 116, 118 (FIG. 3) and 216, 218 (FIG. 4) may also be made of at least one barrier layer that is substantially impermeable to at least one of oxygen, nitrogen, carbon dioxide and/or water vapor. The optional barrier layer of the opposing body panels may be made of similar material as described above in forming the optional barrier layer of the one-time breakable element. The optional barrier layer of the opposing body panels may be located as an inside layer or as an interior layer of the package.

As discussed above, the opposing body panels 16, 18 may be made from multiple layers. Similarly, the opposing body panels 116, 118 of FIG. 3 and 216, 218 of FIG. 4 may be made from multiple layers. For example, the opposing body panels 16, 18 may include a tie layer that attaches to the fin portions 28, 34. The tie layer may be made from various materials such as ethylene vinyl acetate (EVA), anhydride modified polyolefins, anhydride modified ethylene-acrylates, anhydride modified EVAs, acid modified EVAs, acid modified ethylene-acrylates, amorphous polyolefin-modified EVA polymers or combinations thereof. Some examples of anhydride modified polyolefins include anhydride modified high density polyethylene (HDPE), anhydride modified low density polyethylene (LDPE) and anhydride linear low density polyethylene (LLDPE).

An example of a three layer body panel (not shown) includes a first layer having the same materials as described above in making the optional barrier layer of the one-time breakable element, a tie layer and a third layer made of polyolefin(s), such as an LDPE, an HDPE, an LLDPE or combinations thereof. In this embodiment, the first layer would be preferably located on the interior of the body panel with the tie layer being located between the first and third layers.

The components of the reclosable closure arrangement (such as the tracks having integrally formed interlocking profiles and fin portions) may be attached to the body panels of the package by processes such as heat sealing, welding or blocking. The process utilized depends upon the materials from which the bag and the reclosable closure arrangement are made. Specifically, heat sealing is a process whereby materials are fused or melted together. Welding is a process where an intermediate third material is utilized to "glue" similar materials to each other. Blocking is a process where at least sufficient pressure and optional temperature increases result in intimate surface contact adhesion of layers without sealing.

Alternatively, an adhesive seal may be utilized as a fastener or reclosable element of the present invention. Such seals employ a resealable adhesive-type substance that is applied to either one or both of the films forming the package. The adhesive may alternatively be applied to an intermediary base strip. It is contemplated that other closure arrangements, besides adhesive seals and zippers, may be used in the present invention.

According to one process, a reclosable package is formed by providing a first opposing body panel and a second opposing body panel joined with the first opposing body panel along three sides to create a receptacle space having a mouth at one end. A reclosable seal includes a first track and a second track is extruded. The first track includes a first fin portion and a first reclosable element, while the second track includes a second fin portion and a second reclosable element. The first fin portion extends generally downwardly from the first reclosable element. The first fin portion has a first end and a second end being further from the first reclosable element. The second fin portion extends generally downwardly from the second reclosable element. The second fin portion has a first end and a second end being further from the second reclosable element. The first reclosable element and the second reclosable element are releasably engageable to each other. The reclosable seal may include a first and second locking elements and a slider mechanism that engages the locking elements to move between open and closed positions.

The one-time breakable element comprising a first section and a second section is extruded. The one-time breakable element initially extends from the first fin portion to the second fin portion so as to prevent or inhibit tampering with the package prior to being opened. Each of the first and second sections extends upwardly and inwardly from respective second ends of the first and second fin portions so as to form a generally inverted U-shaped or V-shaped cross-sectional configuration. The first and second sections of the one-time breakable element and the first and second fin portions are integrally connected with each other according to one embodiment.

It is contemplated that the first fin portion, second fin portion, first and second sections of the one-time breakable element may be made separately from each other. For example, the first fin portion, second fin portion, first and second sections of the one-time breakable section may be extruded separately from each other. It is contemplated that the first fin section and the first section of the one-time breakable section may be extruded with each other. It is contemplated that the second fin section and the second section of the one-time breakable section may be extruded with each other. According to another embodiment, the first fin section, the second fin section and the one-time breakable element (first and second sections) are extruded separately.

The first opposing body panel is attached to the first section of the one-time breakable element. The second opposing body panel is attached to the second section of the one-time breakable element. The first fin portion extends generally downwardly from the first reclosable element toward the receptacle space. The second fin portion extends generally downwardly from the second reclosable element toward the receptacle space and the reclosable seal extends along the one end of the receptacle space.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A process of forming a reclosable package, comprising:

providing a first opposing body panel and a second opposing body panel joined with the first opposing body panel along three sides to create a receptacle space having a mouth at one end;

extruding a reclosable seal including a first track and a second track, the first track including a first fin portion and a first reclosable element, the second track including a second fin portion and a second reclosable element, the first fin portion extending generally downwardly from the first reclosable element, the first fin portion having a first end and a second end being further from the first reclosable element, the second fin portion extending generally downwardly from the second reclosable element, the second fin portion having a first end and a second end being further from the second reclosable element, the first reclosable element and the second reclosable element being releasably engageable to each other;

extruding a one-time breakable element comprising a first section and a second section, the one-time breakable element initially extending from the first fin portion to the second fin portion so as to prevent or inhibit tampering with the package prior to being opened, sections extending upwardly and inwardly from respective second ends of the fin portions so as to form a generally inverted U-shaped or V-shaped, the first and second sections of the one-time breakable element and the first and second fin portions being integrally connected with each other; such that the first and second sections of the one time breakable element extending upwardly towards the re-closable seal and inwardly form the respective second ends of the first and second fin portions so as to form a generally inverted U-shaped or V-shaped cross-sectional configuration attaching the first opposing body panel to the first section of the one-time breakable element; and attaching the second opposing body panel to the second section of the onetime breakable element, wherein the first fin portion extends generally downwardly from the first reclosable element toward the receptacle space, the second fin portion extends generally downwardly from the second reclosable element toward the receptacle space and the reclosable seal extends along the one end of the receptacle space.

2. The method of claim 1, wherein the one-time breakable element has a preferential area of weakness.

3. The method of claim 2, wherein the preferential area of weakness is a score line.

4. The method of claim 2, wherein the preferential area of weakness is a series of perforations or a highly oriented region.

5. The method of claim 1 further including providing opposing end terminations and placing the opposing end terminations near respective ends of the reclosable seal.

6. The method of claim 1, wherein the reclosable seal is free of pull flanges extending upwardly from the reclosable seal that can be grasped and pulled apart to open the reclosable seal from a sealed form.

7. The method of claim 1 further including forming a bottom gusset with the first and second opposing body panels.

8. The method of claim 1 further including forming a side gusset with the first and second opposing body panels.

9. The method of claim 1, wherein the first and second opposing body panels comprise a polymeric material.

10. The method of claim 1, wherein the first and second opposing body panels comprise a multi-wall paper construction.

11. The method of claim 1, wherein a majority of the first section of the one-time breakable element is attached to the first fin portion and a majority of the second section of the one-time breakable element is attached to the second fin portion.

12. The method of claim 1, wherein the first reclosable element includes a first locking profile and the second reclosable element includes a second locking profile, and further including a slider mechanism slidably mounted to the first and second locking profiles for movement between a closed position and an open position, the first and second profiles being engaged to each other while the slider mechanism is in the closed position, the first and second profiles being disengaged from each other in response to movement of the slider mechanism to the open position.

* * * * *

UNITED STATES PATENT AND TRADEMARK OFFICE

CERTIFICATE OF CORRECTION

PATENT NO. : 7,316,641 B2
APPLICATION NO. : 11/376827
DATED : January 8, 2008
INVENTOR(S) : Rehwinkel et al.

It is certified that error appears in the above-identified patent and that said Letters Patent is hereby corrected as shown below:

At column 11, lines 43-45, please delete the text "sections extending upwardly and inwardly from respective second ends of the fin portions so as to form a generally inverted U-shaped or V-shaped".

Signed and Sealed this

Seventeenth Day of June, 2008

JON W. DUDAS
*Director of the United States Patent and Trademark Office*